US006542130B2

(12) United States Patent
Falk et al.

(10) Patent No.: US 6,542,130 B2
(45) Date of Patent: Apr. 1, 2003

(54) TUNEABLE ANTENNA

(75) Inventors: Kent Falk, Mölnlyce (SE); Ingmar Karlsson, Källered (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 46 days.

(21) Appl. No.: 09/796,359

(22) Filed: Mar. 2, 2001

(65) Prior Publication Data

US 2001/0028329 A1 Oct. 11, 2001

(30) Foreign Application Priority Data

Mar. 3, 2000 (SE) ..... 0000719

(51) Int. Cl.[7] ..... H01Q 13/10
(52) U.S. Cl. ..... 343/771; 343/770; 343/768
(58) Field of Search ..... 343/770, 771, 343/767, 768; H01Q 13/10

(56) References Cited

U.S. PATENT DOCUMENTS

| | | | | |
|---|---|---|---|---|
| 3,701,162 A | * | 10/1972 | Seaton | 343/771 |
| 4,243,990 A | | 1/1981 | Nemit et al. | 343/771 |
| 5,638,079 A | | 6/1997 | Kastner et al. | 343/770 |
| 6,377,204 B1 | * | 4/2002 | Wurman et al. | 343/59 |
| 6,429,825 B1 | * | 8/2002 | Martek | 343/770 |

FOREIGN PATENT DOCUMENTS

| | | |
|---|---|---|
| EP | 0440126 | 8/1991 |
| JP | 7-226617 | 8/1995 |
| WO | WO89/08933 | 9/1989 |
| WO | WO95/15592 | 6/1995 |

OTHER PUBLICATIONS

IEEE Transactions on Antennas and Propagation, vol. 43, No. 8, Aug. 1995, M. Takahashi et al., "Dual Circularly Polarized Radial Line Slot Antennas".

* cited by examiner

*Primary Examiner*—Hoanganh Le

(57) ABSTRACT

An antenna element (30, 31, 32), comprising a wave-guide (1, 1') comprising a number of slots (2, 2', 3, 3') being pairwise arranged, preferably at 90 degrees to one another and +/−45 degrees to the longitudinal direction of the waveguide has been described. The antenna element is coupled to a feeder (5) for providing a first wave inside the wave-guide (W_a) The antenna element comprises at least one amplitude and phase control unit (APC, 14, 15, 16) for controlling the phase and amplitude of a reflected or separately provided second wave (W_b) in relation to the first wave, the second wave propagating inside the wave-guide in an opposite direction to the first wave (W_a), whereby the polarization of an emitted or received wave (W) outside the wave-guide can be controlled. Moreover, a transceiver (33, 34, 35) adapted for controlling the polarization modes and a method for operating such a transceiver has been described.

24 Claims, 12 Drawing Sheets

$$E = \frac{1}{\sqrt{2}} \cdot \left[\left(E_{+\pi/4} + E_{-\pi/4}\right) \cdot \hat{x} + \left(E_{+\pi/4} - E_{-\pi/4}\right) \cdot \hat{y}\right]$$

TUNEABLE ANTENNA

FIELD OF THE INVENTION

The present invention relates to an antenna element based on a slotted wave-guide, a transceiver unit incorporating such an antenna element and methods for operating such antenna elements and transceivers.

BACKGROUND OF THE INVENTION

Slotted wave-guide aerials are popular in many connections and for many applications. One reason is that they combine the emission and feeder element in one unit, which leads to a space efficient design. Slotted wave-guides are also well suited for mass production and many calculation programs exist for dimensioning such wave-guides.

Slotted wave-guides providing a circular polarisation are known in the art.

JP-07226617 shows a circularly polarised antenna having a linear feeder formed on the surface of a dielectric ground conductor and two slots disposed ±45° to a feeding line and 90° to one another.

In an Article in the IEEE, Transactions on antennas and propagation, Vol. 43, No. 8, August 1995, p 874–876 a radial line slot antenna has been disclosed having a plurality of orthogonally arranged slots, the slots furthermore being arranged in a spiralling pattern.

SUMMARY OF THE INVENTION

In FIG. 1, a conventional mobile terminal with transceiver, T, and a conventional vertically polarized base-station antenna, e, and transceiver, f, have been shown. It is assumed that the mobile terminal and the base-station antenna are arranged in a free field.

In a first upright position, a, the antenna of the mobile terminal is parallel to the base-station antenna. In this position, there is an absolute polarisation match and no polarisation loss occurs between the mobile terminal and base-station. If the mobile terminal is positioned at a 45° angle with regard to the node antenna, which is indicated in position b, a polarisation mismatch occurs leading to a 3 dB loss in signal power. Moreover, If the mobile terminal is directed at a 90° angle to the base-station antenna, as seen in position c, a total polarisation mismatch occurs and no signal is transferred.

In a typical environment in which mobile telephones are operated, multiple obstacles will reflect and scatter the signals between mobile terminal and base station. This means that even though the mobile terminal is put in a 90° position with respect to the base-station antenna, some signals will be reflected, whereby the polarisation of the signal will be changed such that it is received at a sufficient signal power level. On the other hand, an absolute polarisation match seldom occurs.

The invention seeks to provide an antenna element in which the polarisation can be controlled arbitrarily and fast.

According to a first aspect of the invention, as defined in claim 1, such a wave-guide is provided.

It is a further object to accomplish an antenna element, which can be produced cost effectively and which is compact.

This object has been accomplished by the subject matter set forth in claim 2.

It is a further object to provide an antenna element in which the polarisation can be controlled in real time.

This object has been accomplished according to claim 3

It is a further object to accomplish a transceiver, which adapts the polarisation with the opposing transceiver with which it communicates.

This object has been achieved by the subject matter defined by claim 15.

It is a further object to accomplish a transceiver in which the polarisation of the transmitted and received waves can be controlled individually and simultaneously.

This object has been accomplished by the subject matter set forth in claim 16.

It is a further object to set forth a method by which the communication between two transceivers can be optimised.

This object is accomplished by the subject matter set forth in claim 17.

It is a further object to accomplish an optimisation of the communication between to transceivers with regard to the quality of the links.

This object has been accomplished by the subject matter set forth in claim 18.

It is a further object to accomplish an airborne radar system being insensitive for disturbances.

This object has been accomplished by the subject matter defined by claim 19.

It is a further object to accomplish a satellite terminal, which optimises quality parameters for the communication.

This object has been accomplished by the subject matter defined by claims 20–22.

Further advantages will appear from the following detailed description of the invention.

DETAILED DESCRIPTION OF PREFERRED EMBODIMENTS OF THE INVENTION

Figure 1:
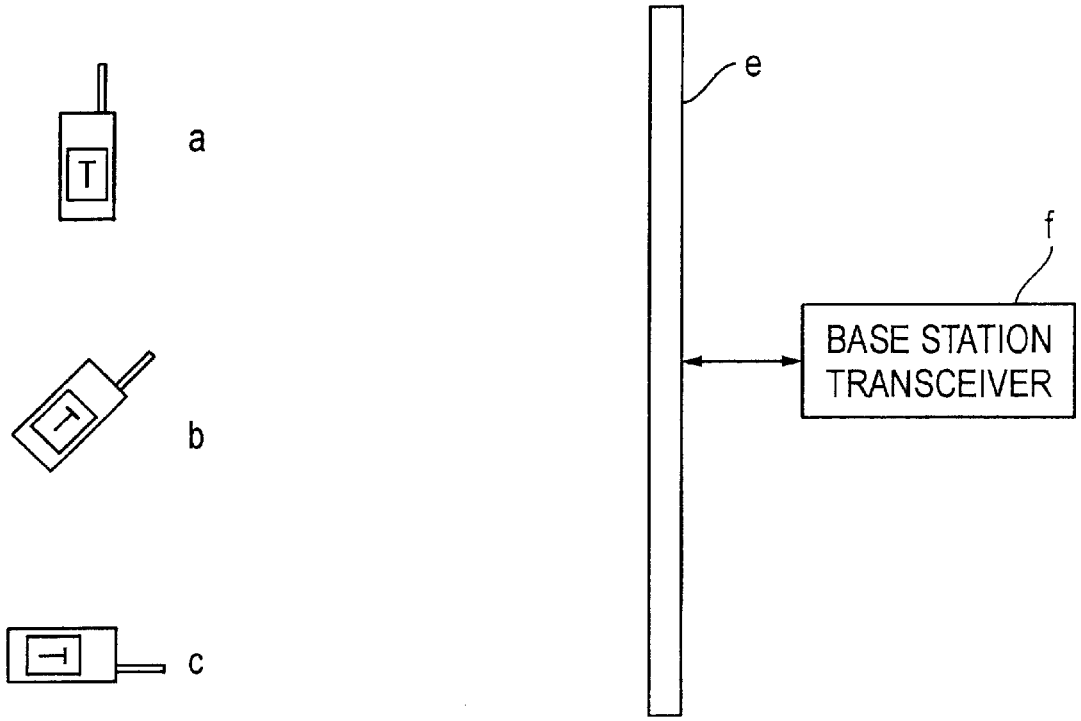
FIG. 1 shows three positions of a mobile terminal and a base station antenna in free space.
Figure 2:
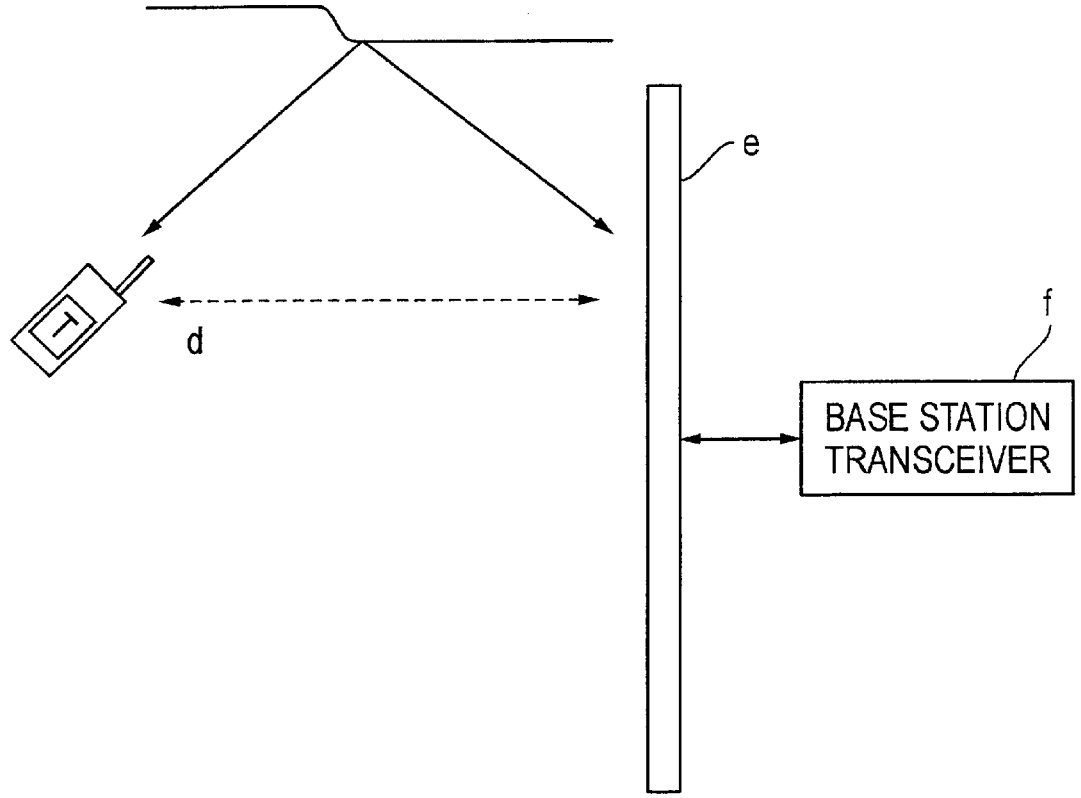
FIG. 2 shows a situation relating to the transmission properties of a mobile terminal and a base station antenna in physical surroundings.
Figure 3:
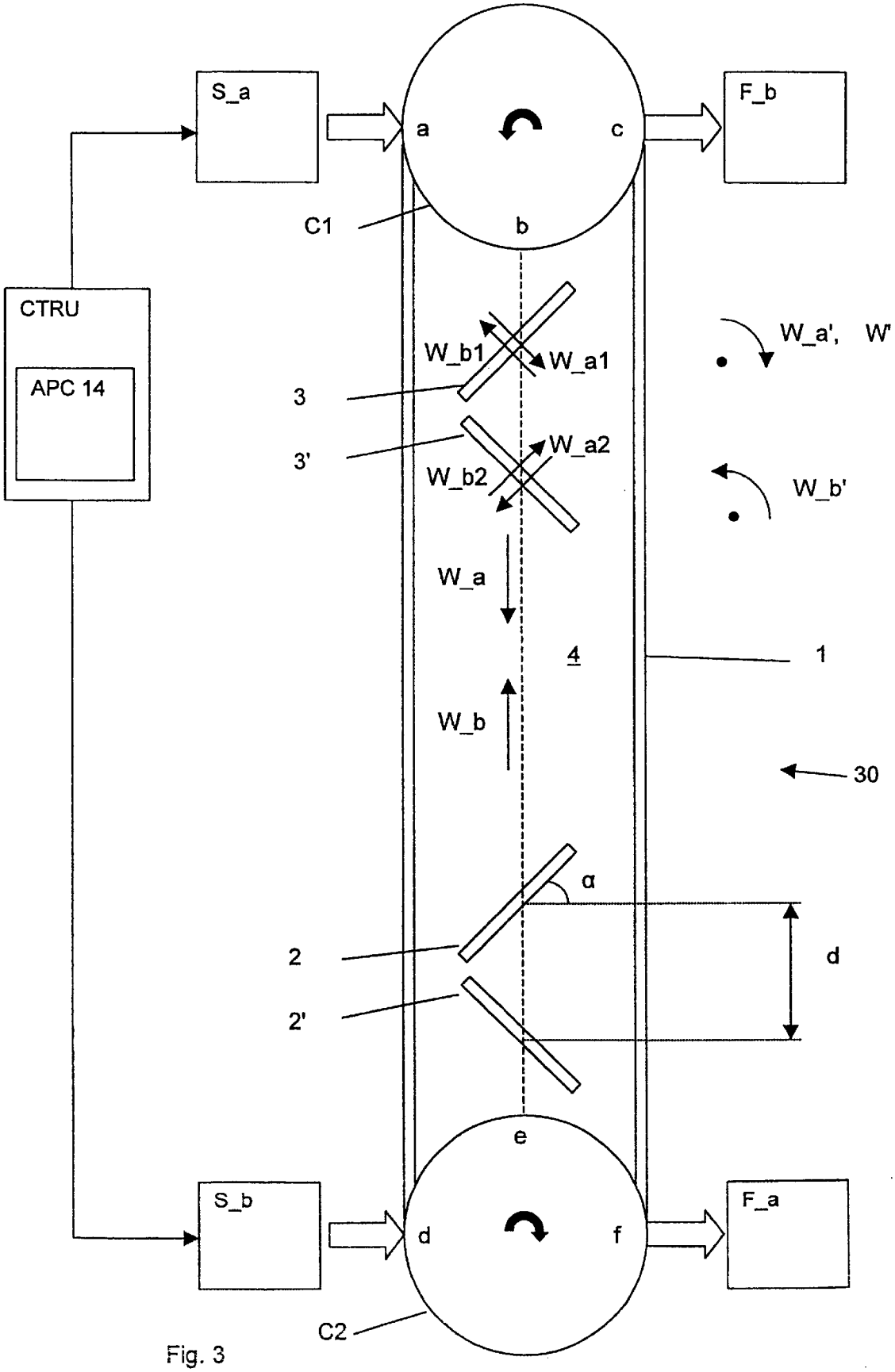
FIG. 3 shows a first preferred embodiment of the tuneable antenna element according to the invention.
Figure 5:
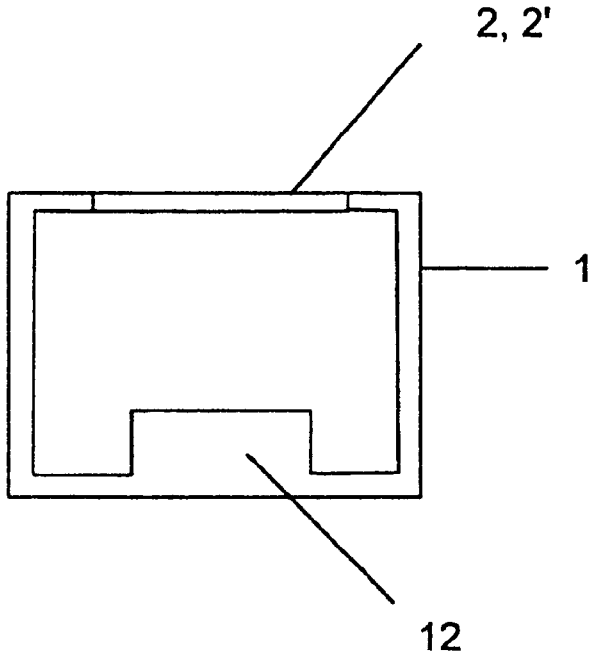
FIG. 5 is a cross-section of FIG. 3.

FIG. 3 shows a first preferred embodiment of an antenna element 34 according to the invention. The antenna element 34 comprises a waveguide 1, which is based on an elongated tubular profile 1. Along a top face 4 of the wave-guide, a number of slots 2, 2', 3, 3' are provided for transceiving electromagnetic signals. In the present embodiment, the wave-guide cross section is formed as a single ridge wave-guide having a ridge 12, as shown in FIG. 5, but other cross-sections such as a rectangular cross section can be used.

The slots are pairwise arranged at a set of first and second angles to the longitudinal direction of the wave-guide, whereby the respective slots in a pair is arranged at a distance d of a quarter guide wavelength and whereby the slots in a pair 2, 2' or 3, 3' are being arranged at a third angle to one another. Advantageously, the set of first and second angles are ±45° and the third angle is 90°, but other angles could be used.

In FIG. 3, only two pairs of slots have been shown for illustrative purposes. However, many additional slots can be. provided whereby the length of the waveguide structure would be extended.

A first circulator C1 is arranged at one end of the wave-guide 1 with a port b facing the wave-guide and a second circulator C2 is arranged in the other end of the wave-guide with a port e facing the waveguide.

A first feeder S_a feeds port a of the first circulator C1, while a second feeder S_b feeds. port d of the second circulator C2.

A signalling and control unit CTRU is adapted to receive an incoming signal and provide two identical output signals The signalling and control unit CTRU comprises an amplitude an phase control unit APC 14 by which the amplitude and the phase can be individually controlled for the two signals.

A first filter F_b has been provided at port c of the first circulator C1, while a second filter F_a has been provided at port f at the second circulator C2.

The signal and control unit, CTRU, effectuates that a first electromagnetic wave W_a enters port a of the first circulator C1, then exits port b and continue travelling inside the wave-guide.

Fractions of the energy of wave W_a is emitted out of each pair 2, 2' and 3, 3' of the perpendicular arranged slots, such that wave components W_a1 and W_a2, relating to each respective slot in the pair, are formed outside the wave-guide as indicated in FIG. 3. Both wave components W_a1 and W_a2 are directed perpendicular to the top face 4 of the wave-guide 1.

The remaining energy of the wave W_a enters port e and exits port f of the second circulator C2 and enters the second filter F_a in which the wave is completely dampened.

Likewise, the signal and control unit effectuates that a second electromagnetic wave W_b enters port d of the second circulator C2, exits port e and is travelling inside the wave-guide, in the opposite direction of the first wave W_a.

Fractions of the energy of wave W_b is emitted out of each pair of perpendicular arranged slots 2, such that perpendicular wave components W_b1 and W_b2, relating to each respective slot, are formed outside the wave-guide. Both wave components W_b1 and W_b2 are directed perpendicular to the slotted wave-guide surface.

The remaining energy of the wave W_b enters port b, exits port c of the first circulator and enters the first filter F_b in which the remaining wave is completely dampened.

The components of waves W_a1 and W_a2 are superposed into a circular polarised field W_a' outside the wave-guide.

Analogously, the components W_b1 and W_b2 are superposed into a circular polarised field W_b' outside the wave-guide, having an opposite circular polarisation to the field W_a'.

The latter two circular polarised fields W_a' and W_b' are again superposed into a resulting field, W', which also is directed perpendicular to the slotted surface of the waveguide.

If W_a and W_b, and hence W_a' and W_b', are equal in amplitude, the resulting wave W' is linearly polarised, whereby the orientation of the linear polarised field is depending on the phase difference between fields W_a and W_b.

If W_a and W_b are unequal in amplitude, the resulting wave W' is elliptical, whereby the direction of the ellipsis is depending on the phase difference between fields W_a and W_b and the axis ratio depends on the amplitude ratio of W_a and W_b.

If either W_a' or W_b' is zero, W' is a circularly polarised wave with a corresponding rotational direction.

Hence, according to the invention, arbitrary polarisation modes can be accomplished.

The above wave-guide with polarisation control can be used for a number of different applications, for instance in mobile terminals for saving emitting power or reduce interference for selected polarisations and hence use available spectrum more efficiently. The polarisation control can also be used to minimise emissions in desired directions.

The above antenna element can for instance be used as a base-station emitting antenna for mobile telephones. It will be readily apparent that the wave-guide can function as a receiving antenna, if receiving units were coupled to each respective circulator over port a of circulator C1 and port d of circulator C2, replacing the feeders S_a and S_b.

The above antenna element can also be used for radar and satellite terminal purposes as will be explained later.

Second Embodiment of the Invention

Figure 4:
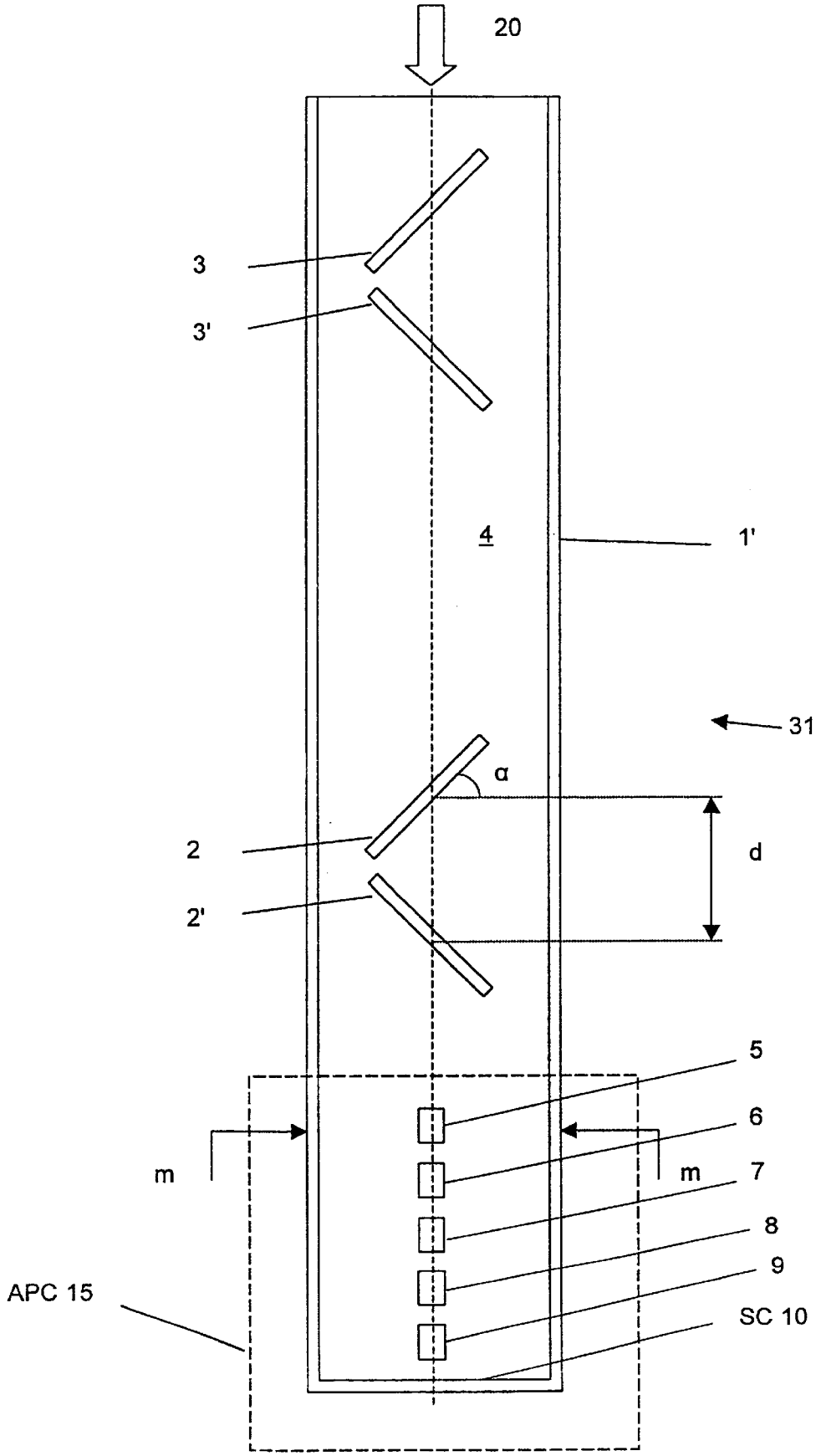
FIG. 4 shows a second preferred embodiment of the tuneable antenna element according to the invention.
Figure 6:
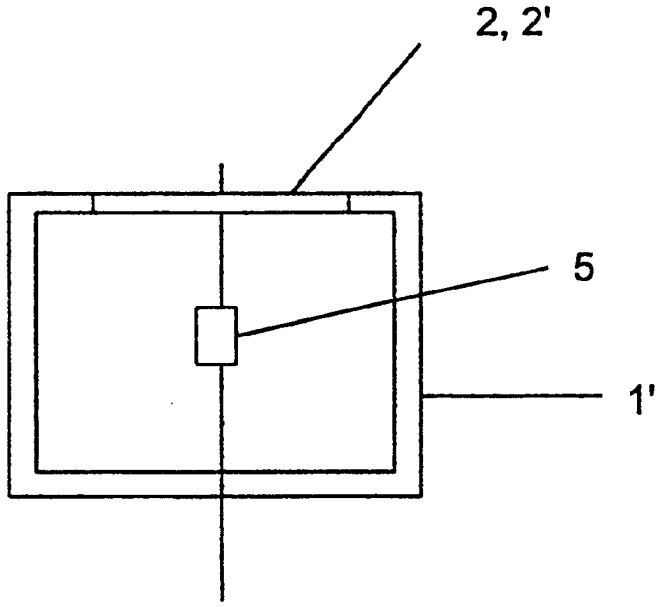
FIG. 6 is a cross section of FIG. 4 along lines m—m.

A second embodiment of the antenna element according to the invention is depicted in FIG. 4. The antenna element 31 of FIG. 4 comprises a waveguide 1' being similar to the waveguide 1 shown in FIG. 3. In FIG. 6, the rectangular cross-section of the wave-guide 1' according to FIG. 4 has been shown.

The antenna element 31 comprises a feeder 20, being arranged in one end of the waveguide 1', while a short-circuit SC10 is arranged at the opposite end. In this example, the short-circuit SC10 consists of the wave-guide wall.

The feeder 20 may comprise a circulator and a filter as shown in FIG. 3.

An amplitude and phase control unit, APC 15, constituted by an array of diodes 4 and a reflector, has been provided. As appears from FIG. 6, the diodes are arranged in the centre of the profile, with connectors mechanically attached to respectively the upper and the lower wall of the guide at isolated points (not shown).

By individually applying a reverse voltage over or a forward current through the diodes 5–9, it is possible to adjust the reflection plane and the dampening of the reflected wave.

A dampening is accomplished by driving a relatively low current trough any of the diodes while a reflection is accomplished by driving a large (for instance 10 times larger) current through any of the diodes.

No dampening takes place if the diodes 5–9 lead no current. In this case, an incoming wave will be reflected by the reflection wall SC 10 of the wave-guide.

By applying various combinations of currents through the array of diodes, 5–9, a given dampening and a given position of the plane of reflection can be accomplished. It is for instance possible to lead small currents through the first and the second diode 5, 6, and a large current through the fourth diode, 8. Consequently, the incoming wave will be dampened at the first and second diode, reflected at the fourth diode and dampened again at the first and second diodes.

Hence, the amplitude and the phase of the reflected wave can be adjusted in relation to the incoming wave.

By way of example, the wave-guide 1' is dimensioned in such a way that with no dampening, the direct wave and the reflected wave are of equal magnitude, resulting in that a linearly polarised wave is emitted through the slots.

When activating the dampening, the ratio between the left and the right hand circular polarised signal is changed and the resulting emitted wave will be elliptically polarised, to a degree depending on the magnitude of the dampening.

Hence, all modes of polarisations, ranging from a linear polarisation, over an elliptical polarisation, to a circular polarisation for one rotational direction can be accomplished by the invention, similar to the embodiment shown in FIG. 3. Optionally, the opposite rotational direction can be accomplished by providing amplification in amplitude and phase control unit APC 15.

Figure 14:
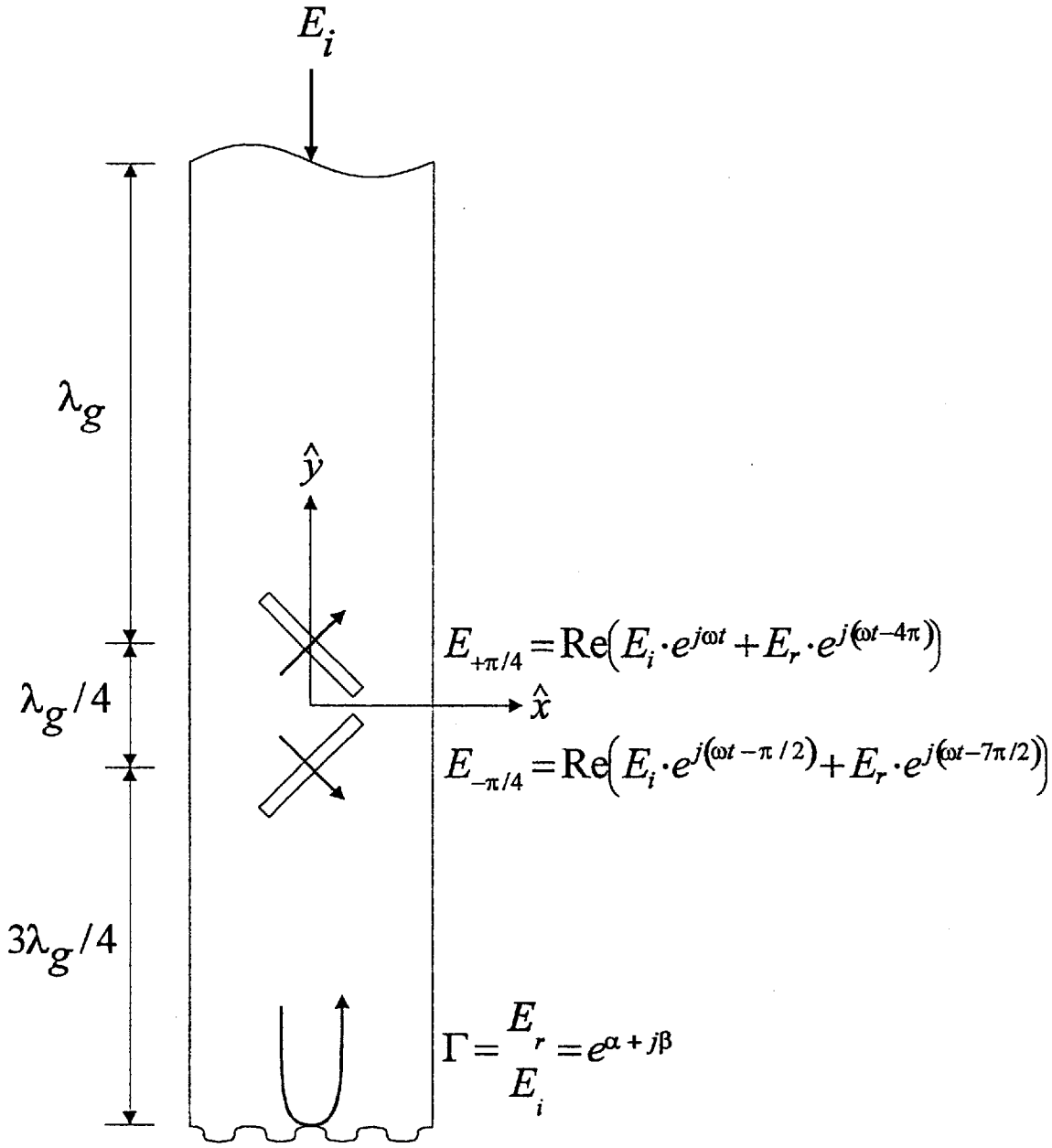

In FIG. 14, a mathematical expression relating to the E-field originating from a pair of slots has been shown. An incoming wave $E_i$ is reflected by the dampening element having the reflection coefficient $\Gamma$. The distance between the pair of slots and the plane of reflection has been chosen to provide simple expressions. The reflected wave is denoted $E_r$.

Figure 15:
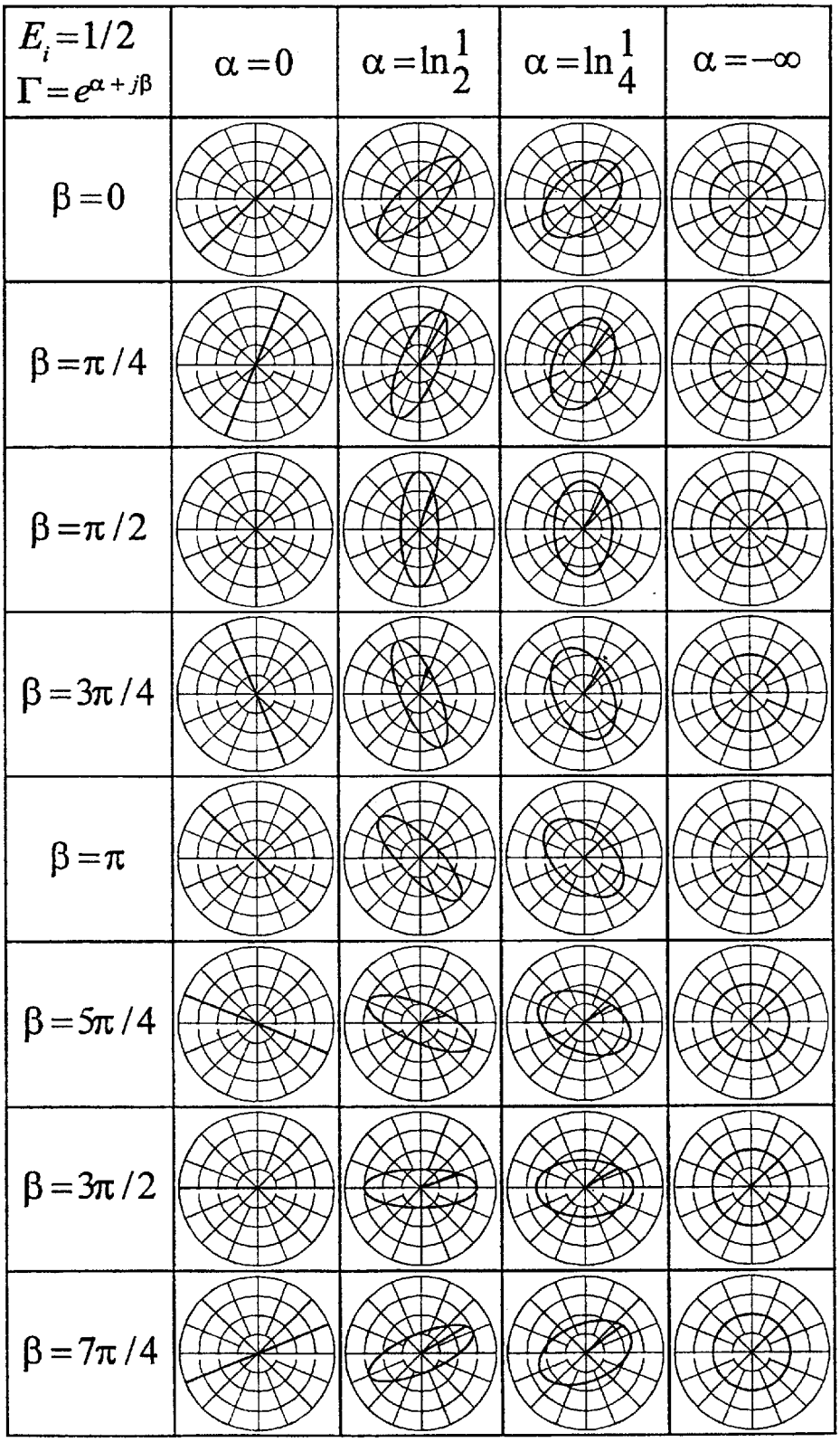
FIG. 15 is a table showing various polarisation modes accomplished by the invention.

In FIG. 15, a table has been provided showing the various modes of polarisation as a function of selected values of the dampening of the reflected wave, $\alpha$, and the phase of the reflected wave, $\beta$. It appears that a circular polarisation occurs if the dampening is total, i.e. $\alpha=-\infty$. It also appears that the polarisation is linear, when the dampening is zero, $\alpha=0$, i.e. total reflection.

As appears from the table in FIG. 15, the linear and elliptical polarisation can furthermore be oriented arbitrarily and the axis ratio of the elliptical polarisation can be controlled arbitrarily by controlling the phase difference between the incoming and the reflected wave.

Third Preferred Embodiment

Figure 7:
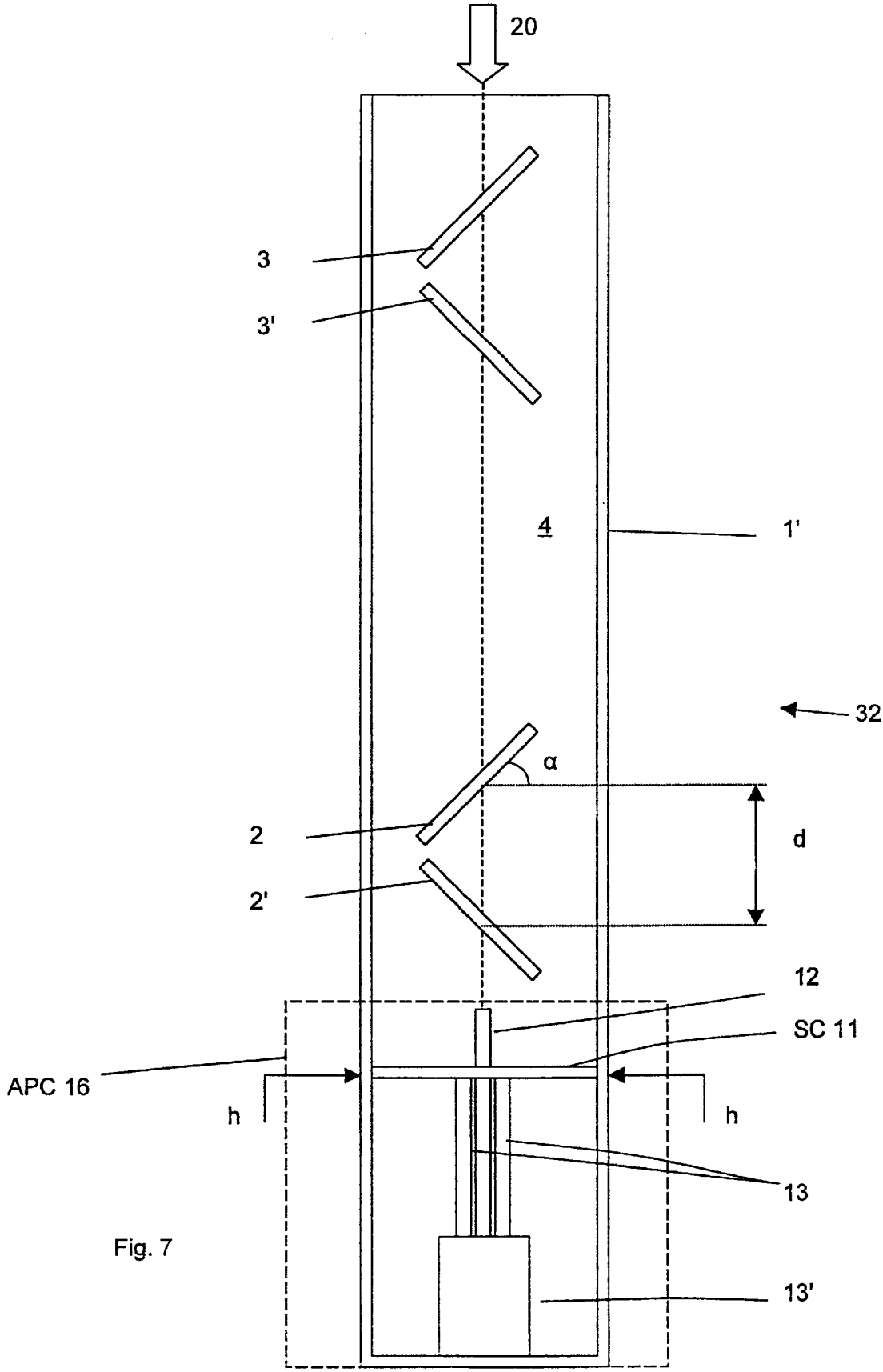
FIG. 7 shows a third preferred embodiment of the tuneable antenna element according to the invention.

In FIG. 7, an alternative embodiment of an antenna element according to the invention has been shown. According to this embodiment, the amplitude and phase control unit, APC, 16 is constituted by an electromechanical arrangement in antenna element 32.

The APC, 16, comprises a reflection plate or short circuit, SC11, which is moved back and forth in order to provide the desired phase variation. A mechanical actuator 13', drives two push rods 13, by which the reflector plate SC11 is moved. The mechanical actuator furthermore drives a dampening member 12, for instance, consisting of carbon, back and forth and independently from the reflector plate SC11. In this manner, the dampening is controlled. When the dampening member 12 extends from the reflector plate 11, a large dampening is accomplished. When the dampening member 12 is level with the reflector plate 11 no dampening or very little dampening is accomplished.

Figure 8:
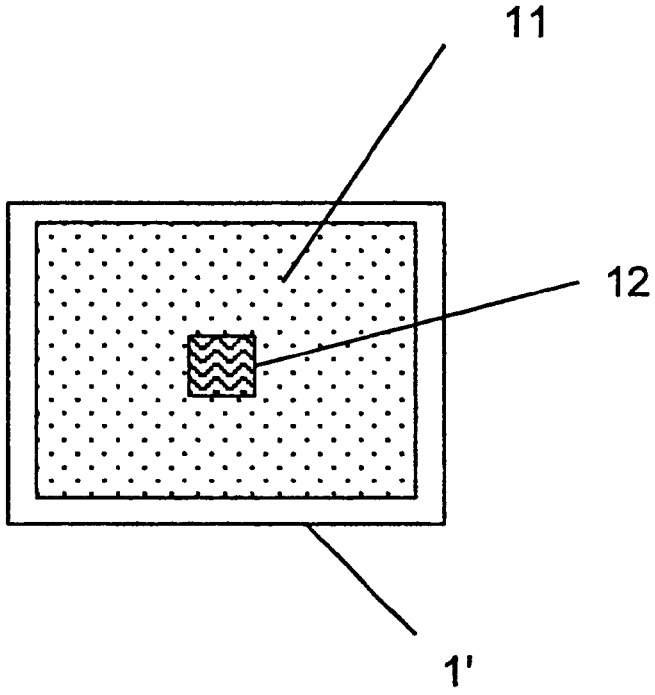
FIG. 8 is a cross-section of FIG. 7 along line h—h.

In FIG. 8, the cross-section of the wave-guide 1', the reflector plate 11 and the dampening member 12 have been shown. It appears that the dampening member 12 is arranged in the centre of the waveguide being surrounded by the reflector plate SC11.

Fourth Preferred Embodiment

Figure 9:
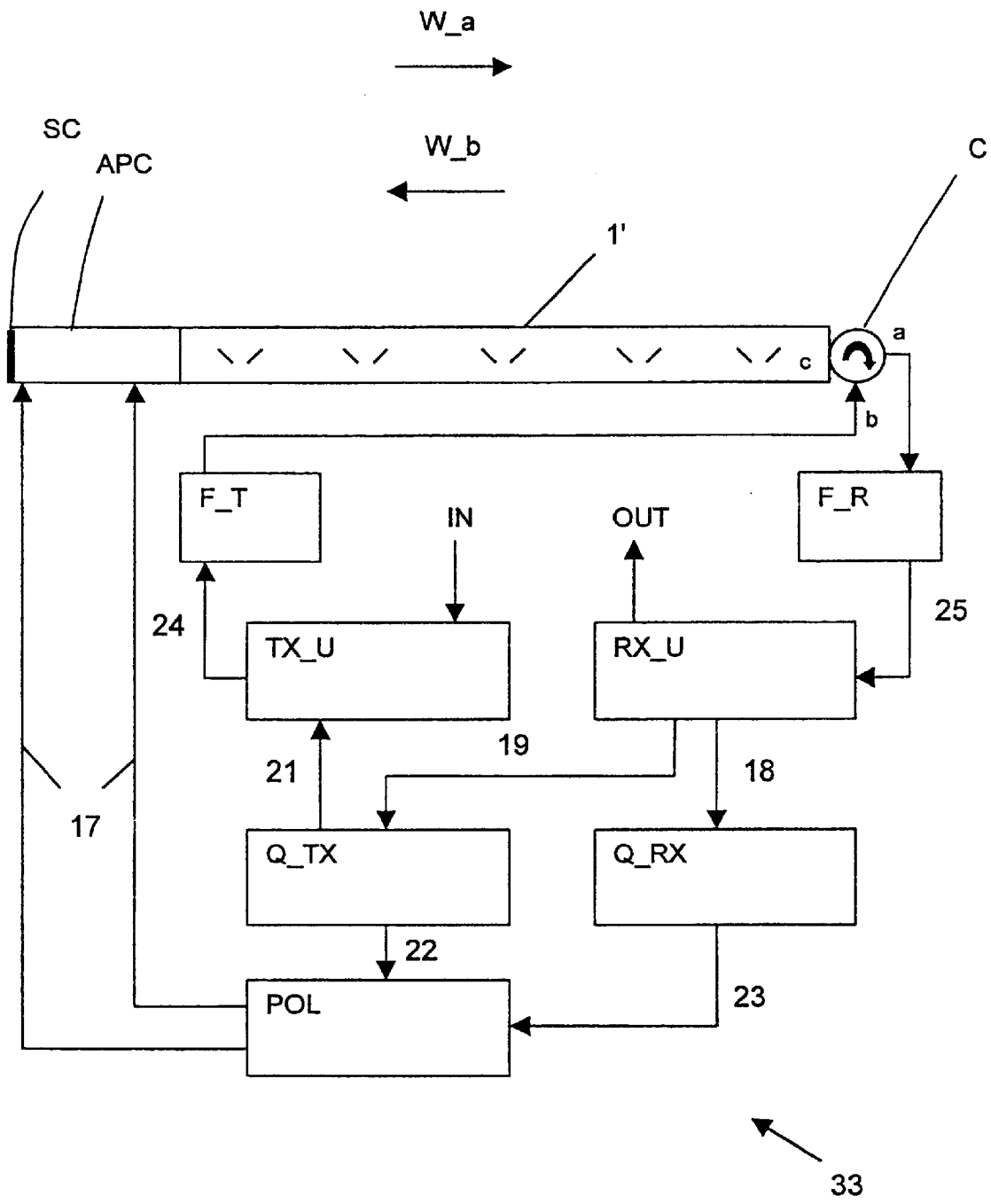
FIG. 9 shows a first embodiment of a transceiver according to the invention.

In FIG. 9, a transceiver 33 according to a further embodiment of the invention has been shown.

The transceiver 33 comprises an antenna element formed by the wave-guide shown in FIG. 5 or 6 and an amplitude and phase control unit, APC, as shown in FIG. 4 or 7.

In FIG. 9, the wave-guide 1', the amplitude and phase control unit APC and the short circuit SC or reflection plate has been indicated. The wave-guide structure is coupled to a circulator C, having ports a, b and c for circulating waves in the direction indicated whereby port c is facing the wave-guide.

Moreover, the antenna element 33 comprises a conventional transmit unit TX_U and a conventional receive unit RX_U, which units are adapted for transmitting and receiving radio signals from an output port and an input port, respectively, so as to transmit data, voice or other types of signals.

Advantageously, the above transceiver is used in a time multiplexed system; i.e. the system either transmits or receives.

The transmit unit TX_U is coupled via line 24 a transmit filter FT to port b on the circulator. The receive unit RX_U is coupled via line 25 to port a through a reception filter F_R to port a on the circulator.

A transmit quality unit Q_TX and a reception quality unit Q_RX have been provided for measuring and controlling the quality loss or attenuation, which is involved when the transceiver communicates with an opposing transceiver.

According to the preferred embodiment, the transmit and reception quality units, Q_TX and Q_RX are adapted to measure a quality parameter, for instance the bit error rate, of respectively the transmitted or received signal over lines 18 and 19. Measuring such parameters are widely known in the art and can be done on traffic signals and test signals. Many types of parameters, such as signal attenuation and signal to noise ratio can be used for determining the quality of the transmission. The transmit quality unit Q_TX is furthermore adapted to issue test signals 21 over the transmit unit TX_U.

A polarisation and control unit POL has been provided for controlling the reflection or dampening in the wave-guide and thereby for controlling the polarisation of the transmitted and/or the received signal in response to respective input signals, 22, 23, from the reception quality unit Q_RX and the transmitting quality unit Q_TX. The polarisation control unit comprises functionality, which produces the appropriate control signals in order to yield the desired polarisation and communicates the desired settings via lines 17 to the amplitude and phase control unit, APC.

One example of an appropriate reception tuning routine, residing in the polarisation and control unit POL, is to monitor the bit error rate of the received signal continuously. Known forward error correction (FEC) routines exist in which the correction activity can be used for determining continuously the bit error rate, without data loss is occurring. According to the invention, the polarisation mode is sweeped through the polarisation range at predetermined intervals in order to find the particular polarisation mode that provides the highest quality parameter, or in this case, the lowest bit error rate. This polarisation mode is chosen for receiving communication from the opposing transceiver until a new value is to be found.

One example of an appropriate transmission tuning routine requires that the opposite transceiver with which the present transceiver communicates, is adapted to measure the signal degradation, for instance in terms of bit error rate and return such data to the present transceiver over an appropriate data channel. In the present embodiment, this information is derived from receive unit RX_U and is signalled to quality transmit unit Q_TX over line 19. The control and polarisation unit POL receives the quality measurements from quality unit Q_TX over line 22 and controls the polarisation mode used for transmission. As stated above, the quality of transmitted signals can be derived from specific test signals or for traffic signals. The modes of polarisation are sweeped as in the above example and the transceiver chooses the polarisation, which gives optimum results. Again, the forward error correction activity can be used for determining the quality parameter.

The above routines are carried out at appropriate intervals, which for instance may correspond to statistical data for typically occurring polarisation changes.

Various other strategies can be utilised for finding an optimum polarisation, for instance by applying predetermined learning sequences from which appropriate quality measures can be derived.

According to the present embodiment, the opposing transceiver need not be provided with means for polarisation control.

It should be understood that in the context of the present application, the term transceiver does not necessarily refer to a bi-directional unit, but also to units, which are adapted for transmission or reception only.

Fifth Embodiment

Figure 10:
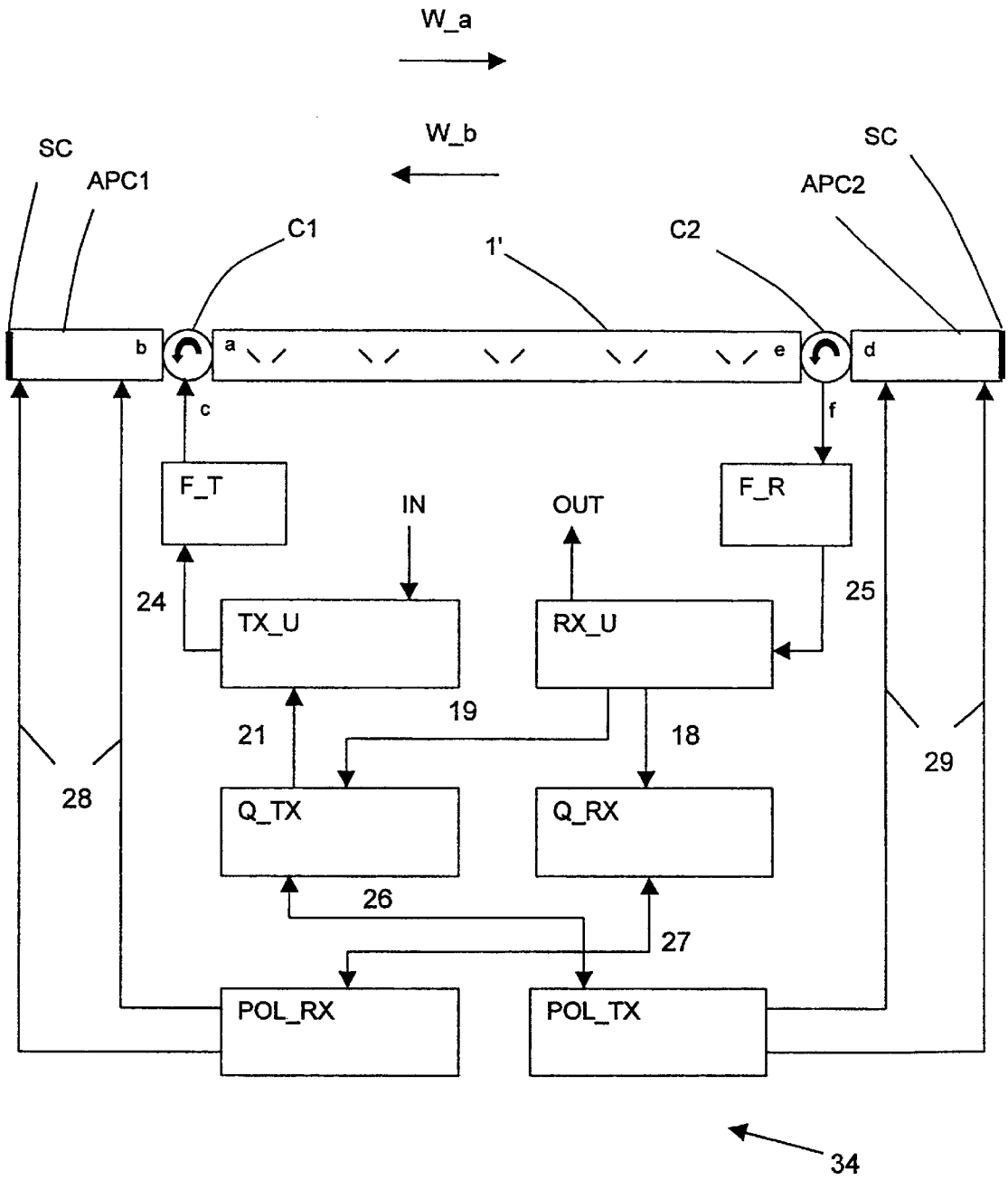
FIG. 10 shows a second embodiment of a transceiver according to the invention.

In FIG. 10, another transceiver embodiment has been shown in which the emitting polarisation and the reception polarisation can be tuned simultaneously and independently.

For this purpose, transceiver 34 comprises the same elements, that is, filters, transmit and receive units, transmit quality unit and receive quality unit, as in the above embodiment of transceiver 33. These elements carry out the same functions and routines as above.

In contrast to the above embodiment, the antenna element comprises two three port circulators, C1 and C2, arranged in each end of the wave-guide 1', and each circulator is coupled to an amplitude and phase control unit, APC1 and APC2, as shown in FIG. 5 and 7.

The transceiver comprises a dedicated transmit polarisation unit POL_TX and a dedicated receive polarisation unit POL_RX, by which the polarisation of the received signals as well as the transmitted signals can be tuned simultaneously.

The dedicated transmit polarisation unit POL_TX controls the first amplitude and control unit, APC1. The dedicated receive polarisation unit controls the second amplitude and phase control unit, APC2. The polarisation units function as explained above.

A wave received through the slots will, in the same manner as shown in FIG. 3, lead to two opposite wave components W_a and W_b, being formed inside the waveguide, as indicated in FIG. 10.

A received wave W_b will travel through the waveguide, enter port a of the first circulator, C1, exit port b, be reflected and have its phase and amplitude regulated according to the processing in the first amplitude and phase control, APC1. The reflected wave will omit port c, (because of un-matched properties with filter F_T?), and travel together with and be superposed with wave W_a. Subsequently a resulting wave will enter port e of the second circulator, C2, exit port f and pass through reception filter F_R for further processing.

A transmit wave W_a, generated by transmit unit TX_U. will pass through transmit filter F_T enter port c of the first circulator, C1, exit port a into the wave-guide member and gradually be emitted trough the slots. The wave will enter port e of the second circulator, C2, be rejected by the reception filter F_R, exit port d and have its amplitude and phase regulated together with being reflected in the second amplitude and phase control unit APC2, re-enter port d of the second circulator and exit port e. The reflected wave will travel through the wave-guide as W_b, generating the resulting waves as discussed above outside the wave-guide. Subsequently the remaining energy of wave W_b will enter port a be reflected in APC1 and enter filter F_T in which remaining energy is absorbed.

Sixth Embodiment

Figure 11:
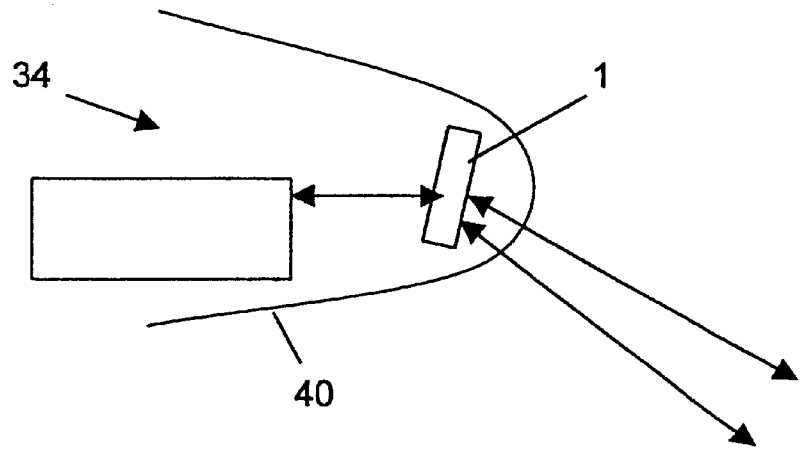
FIG. 11 shows a radar application, in which the transceiver according to FIG. 9 or 10 is used.

According to a further embodiment of the invention, the above waveguide shown in FIG. 9 or 10 is incorporated in a radar arranged in the nose of an aeroplane 40, as shown in FIG. 11.

A radar signal-processing and signal generation unit (not shown) is coupled to the input and the output ports of the transceiver 34 according to FIG. 10.

In one type of military radars for aeroplane use, the emitting aerial and the receiving aerial is mounted together on a roll axis turntable in the nose of the aeroplane. The roll axis turntable enables the aerial to be rotated in order to adjust the polarisation of the emitting beam and the received reflected echo, respectively, independently from the roll of the aeroplane.

In military applications, masking strips of aluminium for instance are dumped and used as a decoy for a following aeroplane. The dumped strips will typically descend through the air in a given orientation, for instance horizontally. By controlling the roll axis turntable and thereby the polarisation it is possible to obviate reflections from the decoy independently of the roll of the aeroplane The roll axis turntable is moved to maintain the aerial in this position independently from the tilt of the aeroplane and thus to compensate for those movements, which inevitably occurs when the aeroplane dives or turns.

According to the invention the above waveguide is used as an emitting/and or receiving aerial and is mounted fixedly with respect to the aeroplane. Thereby, a roll axis turntable is obviated and the radar unit can be rendered more compact.

Further Embodiments

Figure 12:
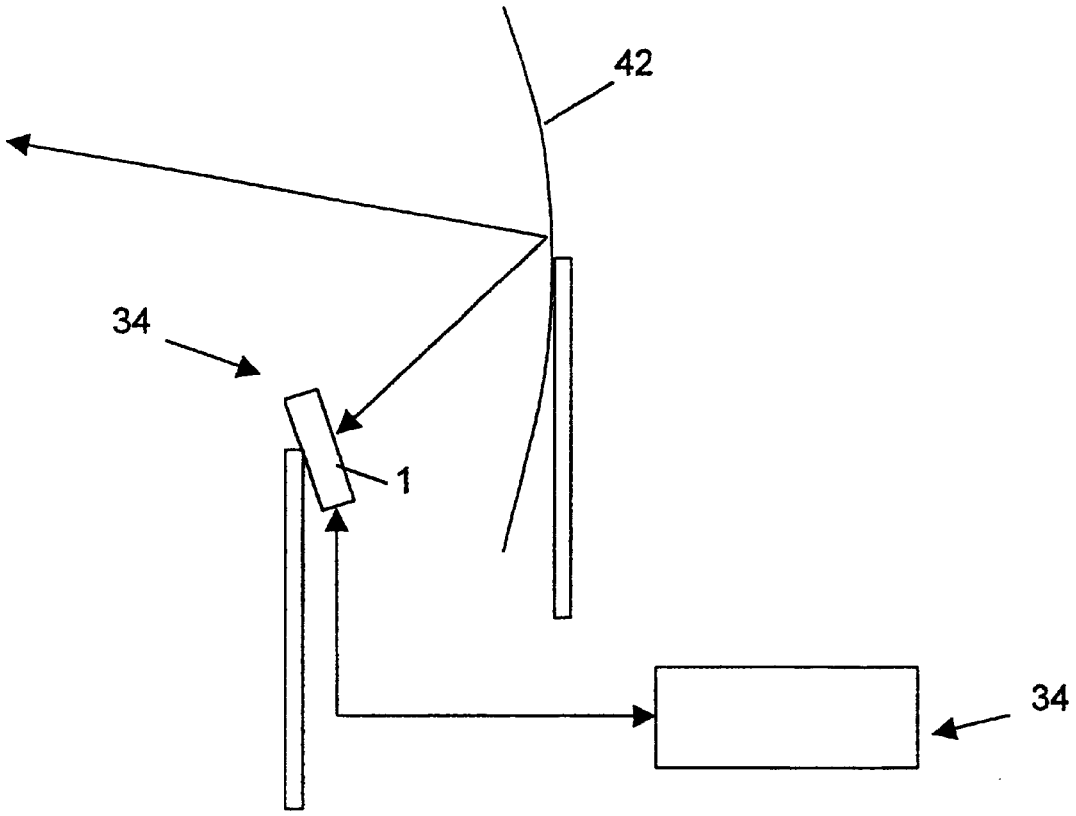
FIG. 12 shows a satellite terminal application of the transceiver according to FIG. 10.

In FIG. 12, another application has been shown. The transceiving unit 33 or 34 of FIG. 9 or 10 is used for a satellite terminal having a reflector 42.

Thereby a low cost adaptable polarisation terminal providing left hand polarised as well as right hand polarised waves has been accomplished. Such a terminal is suitable for Ka and Ku band satellite broadband communication operating over LEO (low earth orbit) or GEO (geo-stationary orbit) satellites.

The adaptable polarisation can for instance replace a feed horn, polariser and an OMT (Ortho Mode Transducer) including the necessary wave-guide plumbing, which is often associated with known feeds.

For typical Ka band satellites, the transmit frequency and the receive frequency is often too far apart to allow both bands to utilise the same slots with good performance.

Figure 13:
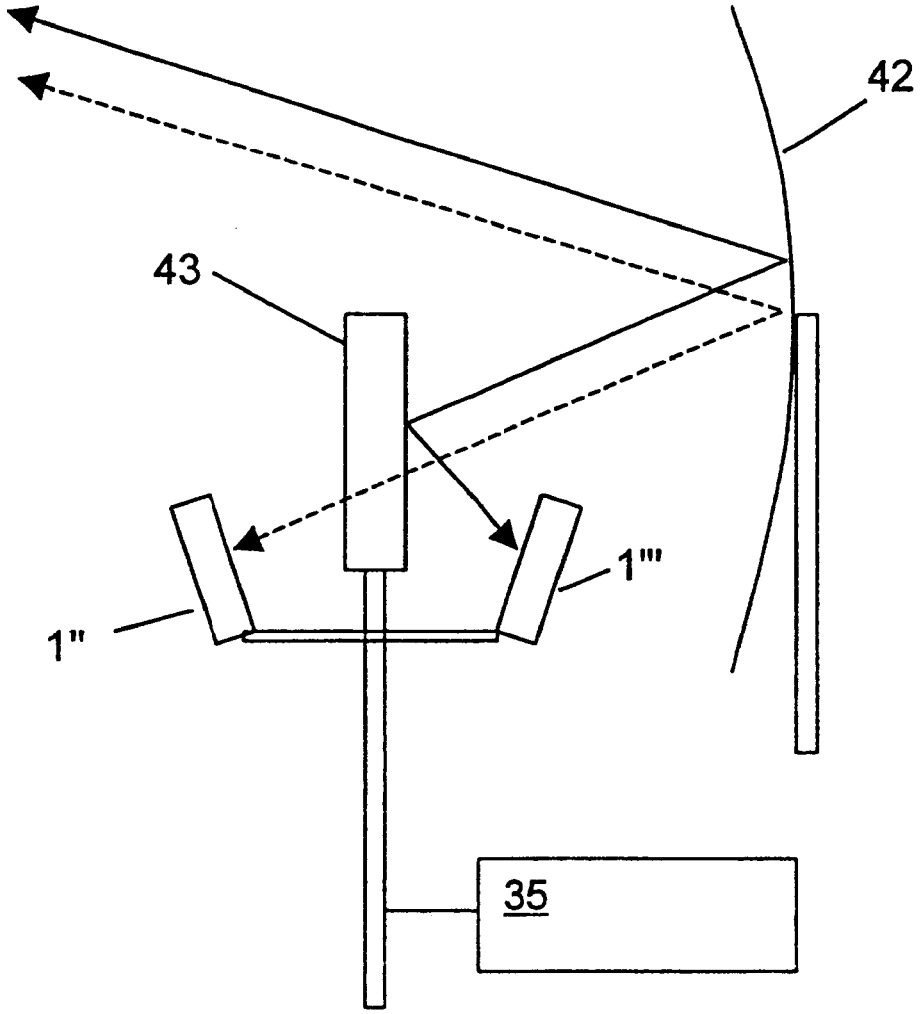
FIG. 13 shows another satellite terminal application of the transceiver according to FIG. 10, FIG. 14 indicates mathematical expressions relating to the waveguide structure according to the invention.

In FIG. 13, two separate wave-guides 1" and 1'" with different slot configurations have been provided as antenna elements in a terminal for satellite communication. The respective antenna elements form part of a transceiver 35 similar to the transceiver shown in FIG. 9. A dichroic sub-reflector 43 has been provided for separating the up- and downlink waves.

What is claimed is:

1. An antenna element comprising a wave-guide having a number of paired slots arranged at a set of first and second angles to the longitudinal direction of the wave-guide, wherein the respective slots in a pair are separated by a distance of one-quarter wavelength and wherein the slots in a pair are arranged at a third angle to one another, the antenna element being adapted to be coupled to:

at least one feeder that provides a first wave of at least one amplitude inside the wave-guide; and an amplitude and phase control unit (APC) that controls the phase and amplitude of a second wave in relation to the first wave, the second wave propagating inside the wave-guide in an opposite direction to the first wave, said APC including:

an array of diodes; and means for reflecting the first wave into the second wave;

whereby the polarisation of an emitted or received wave outside the wave-guide can be controlled.

2. The antenna element according to claim 1, wherein the means for reflecting the first wave into the second wave includes a short circuit (SC) arranged in one end of the wave-guide.

3. The antenna element according to claim 1, wherein the diodes are arranged in the center of the wave-guide.

4. The antenna element according to claim 1, wherein the means for reflecting the first wave into the second wave includes a movable reflection plate.

5. The antenna element according to claim 4, wherein the APC includes a movable dampening member.

6. The antenna element according to claim 5, wherein the dampening member is arranged in the center of the wave-guide surrounded by the reflection plate.

7. The antenna element according to claim 4, further comprising an electromechanical actuator for moving the reflection plate.

8. The antenna element according to claim 1, further comprising a signal and control unit (CTRU) for producing a first signal and a second signal, said signals being converted to the first wave and the second wave, respectively, wherein the CTRU controls the APC in order to control the phase and amplitude of the first wave in relation to the second wave.

9. The antenna element according to claim 1, further comprising a first circulator arranged in one end of the wave-guide, the first circulator being coupled to a first filter for dampening waves directed against the first circulator.

10. The antenna element according to claim 9, further comprising a second circulator arranged in one end of the wave-guide opposite to the first circulator, the second circulator being coupled to a second filter for dampening waves directed against the second circulator.

11. The antenna element according to claim 10, wherein a transmission wave is fed to the first circulator and a reception wave is retrieved from the second circulator.

12. The antenna element according to claim 10, wherein the wave-guide has a rectangular profile.

13. The antenna element according to claim 10, wherein the wave-guide is a single ridge wave-guide.

14. A transceiver comprising:

a slotted wave-guide;

at least one amplitude and phase control unit (APC) arranged in one end of the wave-guide for controlling the polarisation mode of waves being emitted from the wave-guide or received through the wave-guide;

at least one circulator through which a reception wave can be retrieved or a transmission wave can be sent;

a transmit unit and/or a receive unit;

a transmit quality unit and/or a reception quality unit; and a polarisation unit;

whereby the polarisation unit controls the at least one APC in response to respective input signals from the reception quality unit and the transmit quality unit.

15. The transceiver according to claim 14, wherein the polarisation unit includes a dedicated transmit polarisation unit and a dedicated receive polarisation unit, and the transceiver further comprises:

a second circulator arranged opposite to the first circulator; and a second APC arranged opposite to the first APC in an end of the wave-guide;

wherein the dedicated transmit polarisation unit controls the first APC, and the dedicated receive polarisation unit controls the second APC;

whereby the polarisation of the received signals as well as the transmitted signals can be tuned simultaneously and independently.

16. The transceiver according to claim 14, wherein the transceiver forms a portion of a radar system for an aircraft, wherein the polarisation of the transceiver is controlled in response to a rolling motion of the aircraft.

17. The transceiver according to claim 14, wherein at least one antenna element is used in connection with a reflector of a satellite terminal.

18. The transceiver according to claim 17, wherein at least two antenna elements are provided in the satellite terminal, said two antenna elements being adapted to operate at different frequency bands for an uplink signal and a downlink signal, sent from the satellite terminal and to the satellite terminal, respectively.

19. The transceiver according to claim 18, wherein the transceiver interfaces with a dichroic sub-reflector in the satellite terminal for separating the uplink and downlink signals.

20. A method of operating a first transceiver communicating with a second transceiver, said method comprising the steps of:

determining by the first transceiver, a measured quality parameter associated with a signal sent to, or received from, the second transceiver, said signal having a perceived polarisation; and changing by the first transmitter, the polarisation of the signal sent to, or received from, the second transceiver based upon the determined measured quality parameter associated with the signal sent to or received from the second transceiver.

21. The method according to claim 20, wherein the step of determining a measured quality parameter includes performing a polarisation mode sweeping routine in which a plurality of polarization modes and associated values of the quality parameter are measured, and wherein the step of changing the polarisation of the signal sent to and/or received from the second transceiver includes changing the polarization to a polarisation which yields optimum results with regard to the quality parameter.

22. A system for controlling the polarisation of a transmitted or received wave outside of an antenna wave-guide, said system comprising:

an antenna element comprising a wave-guide having a number of paired slots arranged at a set of first and second angles to the longitudinal direction of the wave-guide, wherein the respective slots in a pair are separated by a distance of one-quarter wavelength and wherein the slots in a pair are arranged at a third angle to one another;

at least one feeder coupled to the antenna element, said feeder providing a first wave of at least one amplitude inside the wave-guide; and an amplitude and phase control unit (APC) coupled to the antenna element, said APC controlling a phase and amplitude of a second wave in relation to the first wave, the second wave propagating inside the wave-guide in an opposite direction to the first wave;

whereby, by controlling the phase and amplitude of the second wave, the polarisation of the transmitted or received wave outside the wave-guide is controlled.

23. The system for controlling the polarisation of a transmitted or received wave of claim 22 further comprising a first transceiver coupled to the antenna element, said first transceiver communicating with a second transceiver via signals generated and received by the antenna element, said first transceiver including:

means for determining a measured quality parameter associated with a signal sent to, or received from, the second transceiver, said signal having a perceived polarisation; and means for changing the polarisation of the signal transmitted to, or received from, the second transceiver based upon the determined measured quality parameter associated with the signal transmitted to or received from the second transceiver.

24. The system for controlling the polarisation of a transmitted or received wave of claim 22 further comprising means for simultaneously and independently controlling the polarisation of the received signals and the transmitted signals.

* * * * *